US010910767B1

(12) United States Patent
Chen et al.

(10) Patent No.: US 10,910,767 B1
(45) Date of Patent: Feb. 2, 2021

(54) FLOATING FEMALE SOCKET WITH SELF-RETURN FUNCTION AND COAXIAL CONNECTOR INCLUDING SUCH FEMALE SOCKET

(71) Applicant: Goldenconn Electronic Technology Co., Ltd, Suzhou (CN)

(72) Inventors: Jinsong Chen, Suzhou (CN); Zhigang He, Suzhou (CN); Mao Lu, Suzhou (CN); Guangcai Fan, Suzhou (CN)

(73) Assignee: Goldenconn Electronic Technology Co., Ltd, Suzhou (CN)

( * ) Notice: Subject to any disclaimer, the term of this patent is extended or adjusted under 35 U.S.C. 154(b) by 0 days.

(21) Appl. No.: 16/637,291

(22) PCT Filed: Dec. 10, 2019

(86) PCT No.: PCT/CN2019/124151

§ 371 (c)(1),
(2) Date: Feb. 7, 2020

(87) PCT Pub. No.: WO2020/215742

PCT Pub. Date: Oct. 29, 2020

(30) Foreign Application Priority Data

Apr. 25, 2019 (CN) ..... 2019 1 0339450

(51) Int. Cl.
*H01R 9/05* (2006.01)
*H01R 13/631* (2006.01)
(Continued)

(52) U.S. Cl.
CPC ..... *H01R 13/6315* (2013.01); *H01R 13/111* (2013.01); *H01R 13/502* (2013.01);
(Continued)

(58) Field of Classification Search
CPC ..... H01R 13/6315; H01R 13/111; H01R 13/502; H01R 13/6581; H01R 24/38; H01R 2103/00
(Continued)

(56) References Cited

U.S. PATENT DOCUMENTS 5,971,810 A * 10/1999 Taylor ..... H01R 24/38 439/675
6,273,741 B1 * 8/2001 Schultz ..... H01R 13/6272 439/358
(Continued)

FOREIGN PATENT DOCUMENTS

CN 10377969 5/2014
CN 206116672 4/2017
(Continued)

*Primary Examiner* — Abdullah A Riyami
*Assistant Examiner* — Nelson R. Burgos-Guntin
(74) *Attorney, Agent, or Firm* — Sand, Sebolt & Wernow Co., LPA

(57) ABSTRACT

Disclosed is a floating female socket with a self-return function, which includes a female socket insulator, a female socket cover, a female socket terminal, a shielding housing, and an elastic guide plate. Two elastic guide plates are disposed, which are formed by upwardly extending left and right side walls of the shielding housing. The elastic guide plates each include an elastic side top and an arc-shaped guide part, where the elastic side top is configured to jack up against the female socket cover and is formed by inwardly extending an inner wall of the elastic guide plate. The arc-shaped guide part is formed by externally bending and extending a free end of the elastic guide plate.

13 Claims, 10 Drawing Sheets

(51) Int. Cl.

| | |
|---|---|
| ***H01R 13/11*** | (2006.01) |
| ***H01R 13/6581*** | (2011.01) |
| ***H01R 24/38*** | (2011.01) |
| ***H01R 13/502*** | (2006.01) |
| *H01R 103/00* | (2006.01) |

(52) U.S. Cl.
CPC ..... *H01R 13/6581* (2013.01); *H01R 24/38* (2013.01); *H01R 2103/00* (2013.01)

(58) Field of Classification Search
USPC ..... 439/63, 581, 578
See application file for complete search history.

(56) References Cited

U.S. PATENT DOCUMENTS 10,418,731 B2 9/2019 Hasegawa et al.
2006/0183373 A1* 8/2006 Finke ..... H01R 13/5221 439/578
2010/0105246 A1* 4/2010 Burris ..... H01R 24/44 439/578
2010/0159713 A1* 6/2010 Nishihira ..... H01R 24/38 439/39
2010/0178799 A1* 7/2010 Lee ..... H01R 9/0527 439/578
2010/0304579 A1* 12/2010 Kisling ..... H01R 13/6275 439/63
2010/0330819 A1* 12/2010 Stein ..... H01R 43/26 439/63
2013/0029522 A1* 1/2013 Holliday ..... H01R 24/40 439/584
2015/0024628 A1* 1/2015 Haegele ..... H01R 9/0524 439/585
2015/0325964 A1* 11/2015 Kunieda ..... H01R 24/38 439/578
2015/0349454 A1* 12/2015 Kunieda ..... H01R 24/40 439/578
2016/0164232 A1* 6/2016 Lane ..... H01R 24/50 439/578
2019/0052002 A1 2/2019 Hasegawa et al.

FOREIGN PATENT DOCUMENTS

| | | |
|---|---|---|
| CN | 109462087 | 3/2019 |
| CN | 109962367 | 7/2019 |
| CN | 209709253 | 11/2019 |
| JP | 2019033034 | 2/2019 |

* cited by examiner

FLOATING FEMALE SOCKET WITH SELF-RETURN FUNCTION AND COAXIAL CONNECTOR INCLUDING SUCH FEMALE SOCKET

TECHNICAL FIELD

The present disclosure relates to the field of electrical connector technologies, and in particular, to a floating female socket with a self-return function and a coaxial connector including such a female socket.

BACKGROUND

With the development of electronic element technologies, electronic elements become increasingly miniaturized and modular, and higher requirements are imposed on assembly reliability and transmission stability of the electronic elements. Coaxial connectors are connector products with a relatively strong transmission capability among existing ones, and are widely applied to industries such as power systems, communications networks, finance and manufacturing, elevators, industrial automation, medical equipment, office devices, household appliances, and military manufacturing. The coaxial connectors each generally includes a male socket and a female socket that can be interconnected. A position of the male socket easily deviates relative to the female socket during insertion. Consequently, assembly difficulty increases and assembly efficiency decreases. Moreover, an assembled connector may even affect stability of signal conduction, making products malfunction. To resolve this technical problem, floating female sockets emerge on the market. On a floating female socket, a female socket cover can shift adaptively for position adjustment, so that a core shaft of the male socket is inserted in a correct position relative to a female socket terminal, thereby avoiding damage to fitting pieces caused by rigid assembly. However, after the core shaft of the male socket is removed, the female socket cover cannot return to its position correctly in time, causing adverse impact on the next insertion of the core shaft of the male socket. Therefore, the preceding problem needs to be resolved urgently.

SUMMARY

The present disclosure provides a floating female socket that has a simple structural design, is easy to install, enables a female socket terminal to automatically correct a position relative to a core shaft, and enables a female socket cover to self return to its original position after the core shaft is removed.

The present disclosure further provides a coaxial connector including the floating female socket with a self-return function.

To address the preceding technical problem, the present disclosure relates to a floating female socket with a self-return function, including a female socket insulator, a female socket cover floating relative to the female socket insulator, a female socket terminal, and a shielding housing enclosing the female socket insulator. The female socket cover is sleeved on and fastened to the female socket terminal. In addition, the floating female socket further includes two elastic guide plates that are formed by upwardly extending left and right side walls of the shielding housing. The elastic guide plates each include an elastic side top and an arc-shaped guide part, where the elastic side top is configured to jack up against the female socket cover and is formed by inwardly extending an inner wall of the elastic guide plate. The arc-shaped guide part is formed by externally bending and extending a free end of the elastic guide plate. When a male socket of a coaxial connector is inserted and removed relative to the female socket of the coaxial connector, the female socket cover is capable of fine-tuning and correcting a position relative to the female socket insulator along an X-axis direction and/or a Y-axis direction under an action of the elastic side top, so that the female socket cover and the female socket terminal reside in correct relative positions and get ready for a next plug-in mounting of the male socket of the coaxial connector.

As a further improvement to the technical solution, the elastic side top is S-shaped, and externally extends away from a side wall of the female socket cover.

As a further improvement to the technical solution, inwardly bent elastic upper tops extend upwardly from front and rear side walls of the shielding housing to elastically abut an external enclosure of the male socket.

As a further improvement to the technical solution, four such elastic upper tops are disposed and are evenly and circumferentially distributed along a central axis of the shielding housing.

As a further improvement to the technical solution, the female socket terminal comprises a conduction part, insertion parts disposed on left and right sides of the conduction part, and an elastic support part fastened beneath the conduction part. The elastic support part is fastened in a cavity of the female socket insulator. The female socket cover covers and clasps the conduction part from directly above, and insertion slots matched with the insertion parts are disposed in a cavity of the female socket cover. Further, the female socket cover is totally separated from the female socket insulator, and is supported only by the female socket terminal. When the male socket of the coaxial connector is inserted relative to the female socket of the coaxial connector, the female socket cover is capable of position fine-tuning relative to the female socket insulator along the X-axis direction, the Y-axis direction, and/or a Z-axis direction with help of the elastic support part, so that a male socket terminal resides in a correct insertion position relative to the conduction part.

As a further improvement to the technical solution, the elastic support part is constituted by a front connection body and a rear connection body, where the front connection body includes a front multi-bend elastic segment that is formed by downwardly extending a front side wall of the conduction part, and a front fastening segment that horizontally extends forward along a lower end of the front multi-bend elastic segment and that is inserted into a front side wall of the female socket insulator. The rear connection body includes a rear multi-bend elastic segment that is formed by downwardly extending a rear side wall of the conduction part, and a rear fastening segment that horizontally extends backward along a lower end of the rear multi-bend elastic segment and that is inserted into a rear side wall of the female socket insulator.

As a further improvement to the technical solution, the front multi-bend elastic segment and the rear multi-bend elastic segment are both S-shaped and extend in opposite directions.

As a further improvement to the technical solution, two stop blocks are disposed at the female socket cover, and are formed by externally extending a bottom wall of the female socket cover along left and right directions.

As a further improvement to the technical solution, protruding parts are disposed on both the left and right side walls of the shielding housing and grooves matched with the protruding parts are correspondingly disposed on left and right side walls of the female socket insulator.

In addition, the present disclosure further discloses a coaxial connector, including a male socket and a female socket that are interconnected, where the female socket is the foregoing floating female socket with a self-return function.

According to the technical solution, the female socket cover can perform self-adaptive position shifting for adjustment, until the core shaft of the male socket resides in a correct assembly position relative to the female socket terminal, thereby reducing impact on signal transmission stability resulted from damaged fitting pieces caused by rigid assembly. More importantly, after the core shaft of the male socket is removed, the female socket cover self returns to its original position under an action of jack-up force from the elastic side top, and the female socket terminal is correspondingly caused to self return to its original position. In this way, a position displacement of the female socket terminal relative to the core shaft of the male socket is controlled within a proper range, thereby facilitating a next plug-in mounting of the core shaft of the male socket.

BRIEF DESCRIPTION OF DRAWINGS

To describe the technical solutions in the embodiments of the present disclosure or in the prior art more clearly, the following briefly describes the accompanying drawings required for describing the embodiments or the prior art. Apparently, the accompanying drawings in the following description show merely some embodiments of the present disclosure, and a person of ordinary skill in the art may derive other drawings from these accompanying drawings without creative efforts.

1. Male socket; 2. Female socket; 21. Female socket insulator; 211. Groove; 22. Female socket cover; 221. Insertion slot; 222. Stop block; 23. Female socket terminal; 231. Conduction part; 232. Insertion part; 233. Elastic support part; 2331. Front connection body; 23311. Front multi-bend elastic segment; 23312. Front fastening segment; 2332. Rear connection body; 24. Shielding housing; 241. Elastic guide plate; 2411. Elastic side top; 2412. Arc-shaped guide part; 2413. Press-formed stop protrusion; 242. Elastic upper top; 243. Protruding part

DESCRIPTION OF EMBODIMENTS

In the description of the present disclosure, it should be understood that directions or position relationships indicated by terms "left", "right" "up", "down", "front", "rear", and the like are based on directions or position relationships shown by the accompanying drawings, which are used only for describing the present disclosure and for description simplicity, but do not indicate or imply that an indicated apparatus or element must have a specific orientation or must be constructed and operated in a specific orientation. Therefore, this cannot be understood as a limitation to the present disclosure.

Figure 1:
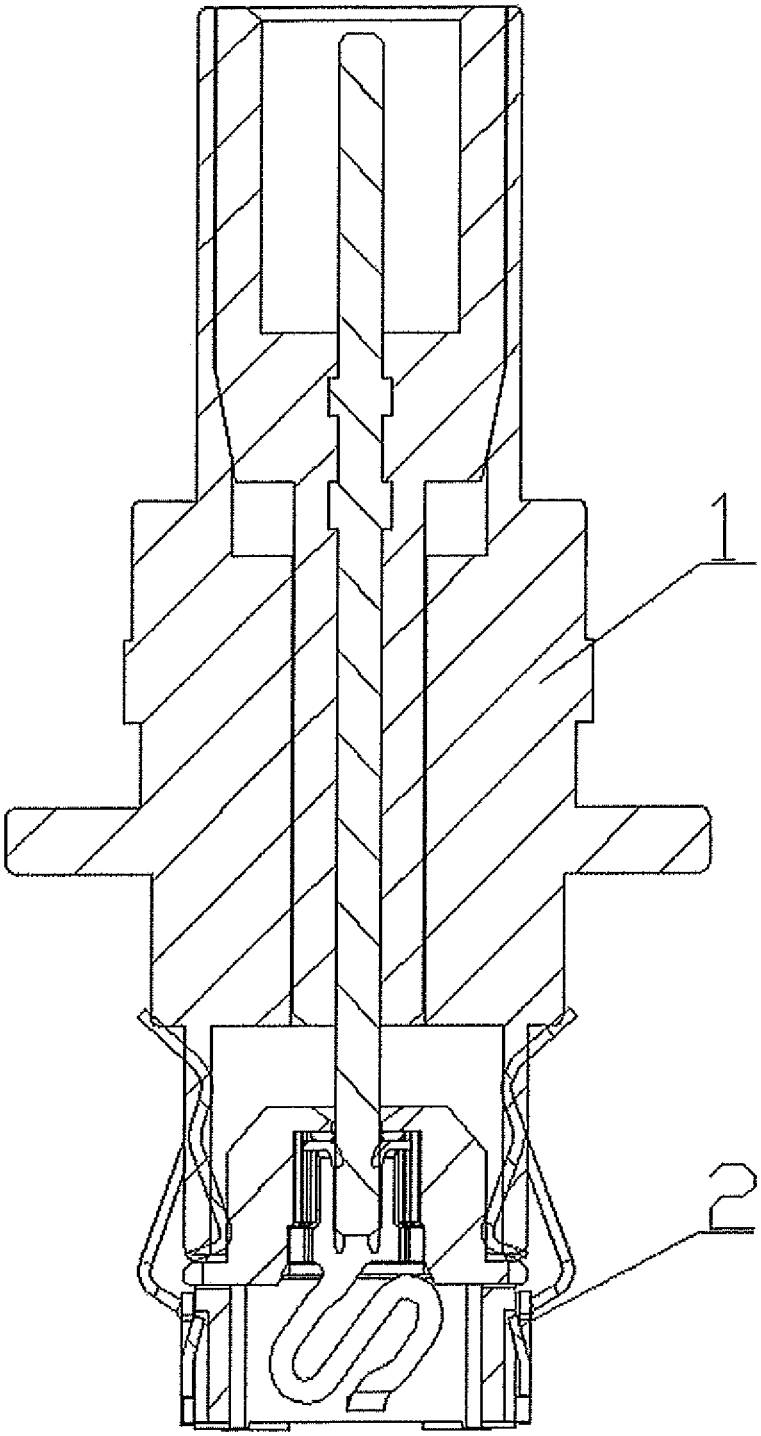
FIG. 1 is a schematic diagram of assembly of a coaxial connector according to the present disclosure.

The following further describes in detail the content provided in the present disclosure with reference to specific embodiments. FIG. 1 is a schematic diagram of assembly of a coaxial connector according to the present disclosure. A male socket 1 is inserted into a female socket 2, and a core shaft of the male socket 1 always leans tightly against a female socket terminal 23, so as to transmit power or signals.

Figure 2:
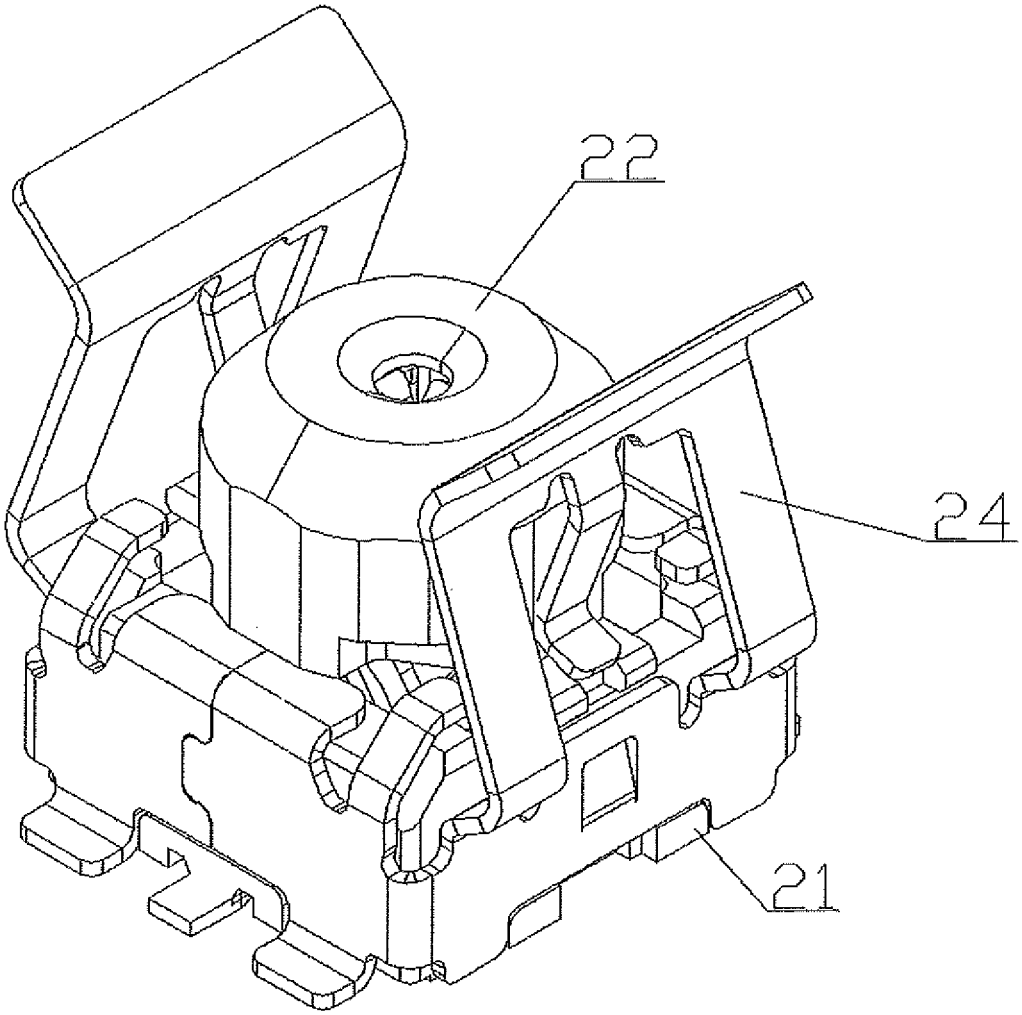
FIG. 2 is a perspective view of a floating female socket with a self-return function according to the present disclosure.
Figure 3:
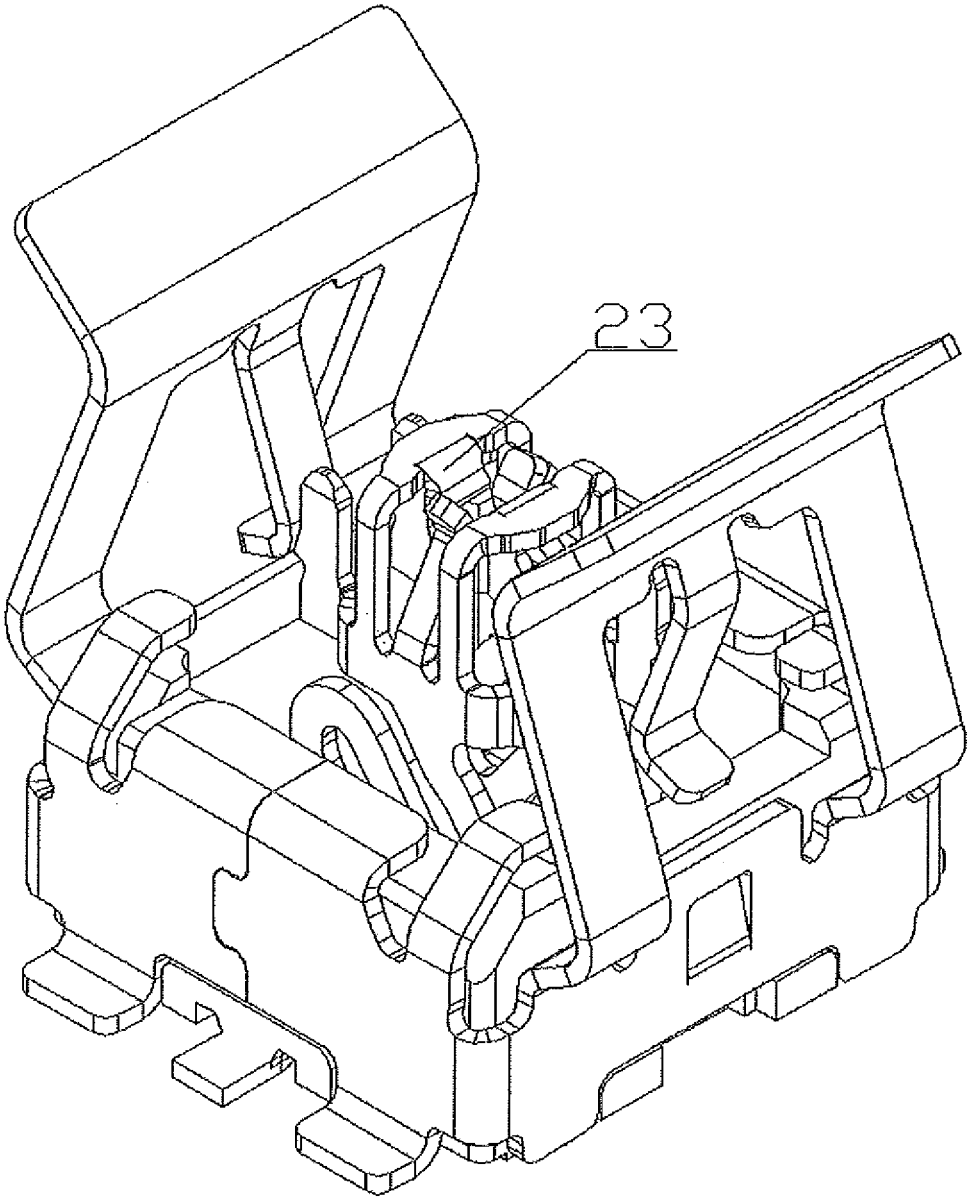
FIG. 3 is a perspective view of a floating female socket with a self-return function (excluding a female socket cover) according to the present disclosure.
Figure 4:
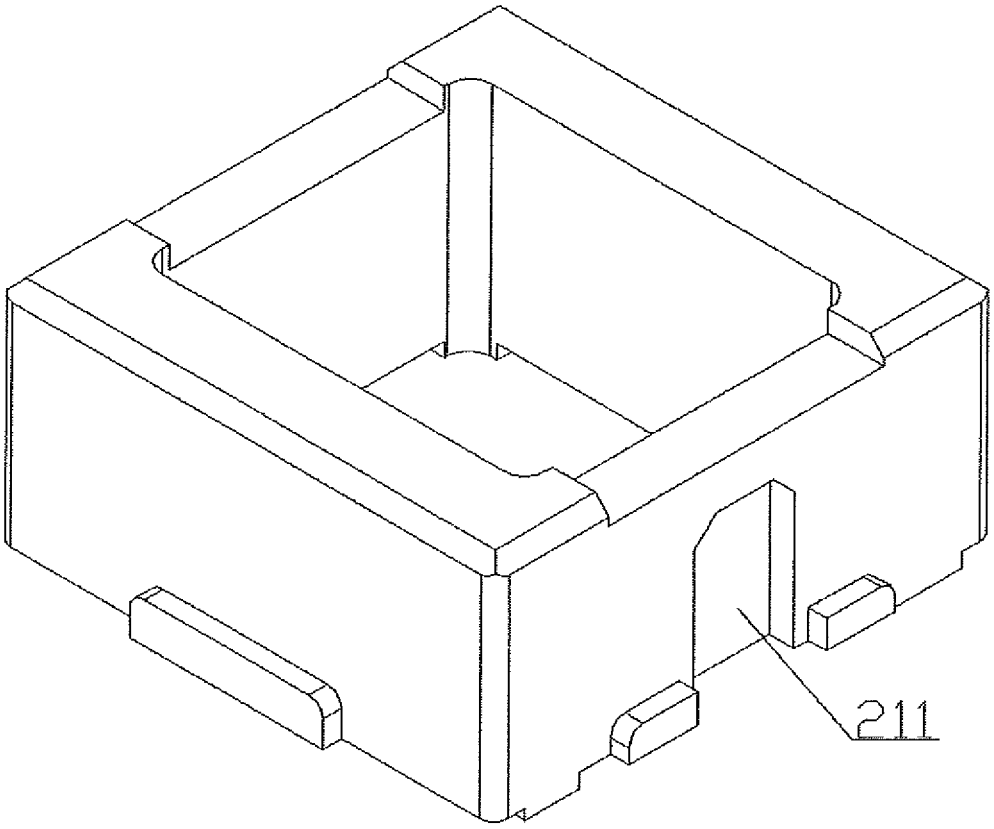
FIG. 4 is a perspective view of a female socket insulator in a floating female socket with a self-return function according to the present disclosure.
Figure 5:
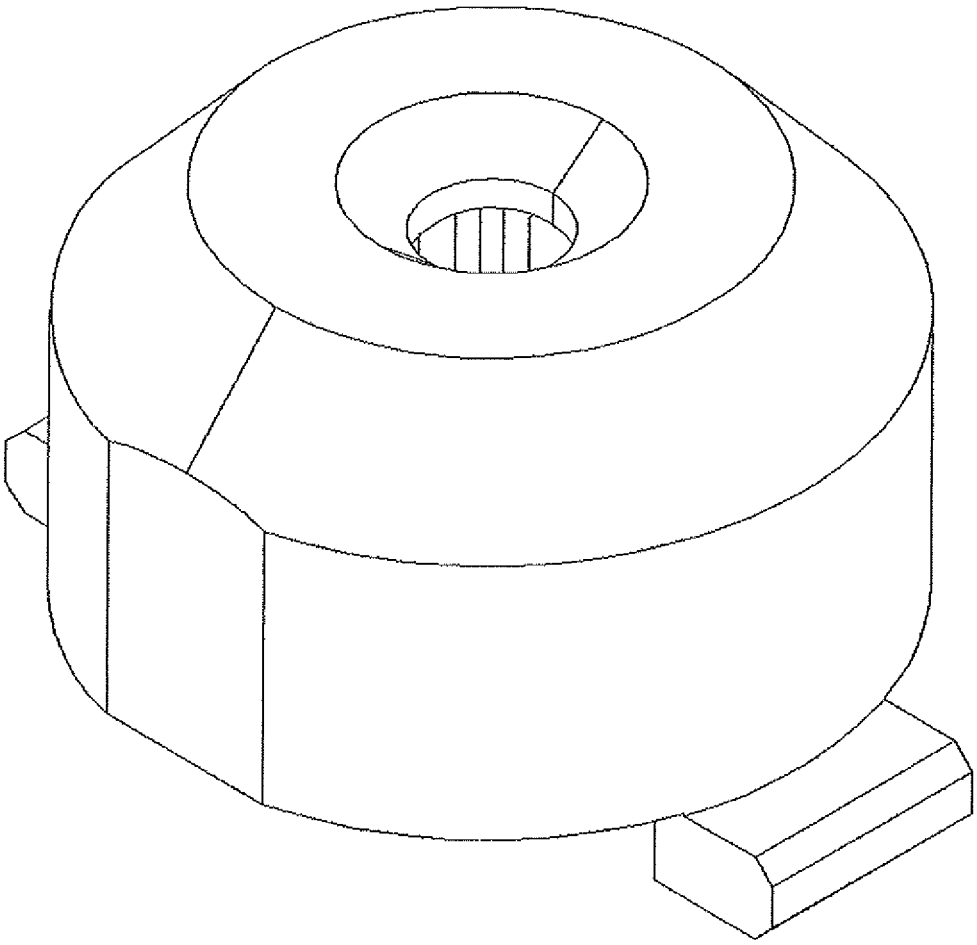
FIG. 5 is a perspective view of a female socket cover in a floating female socket with a self-return function from one angle according to the present disclosure.
Figure 6:
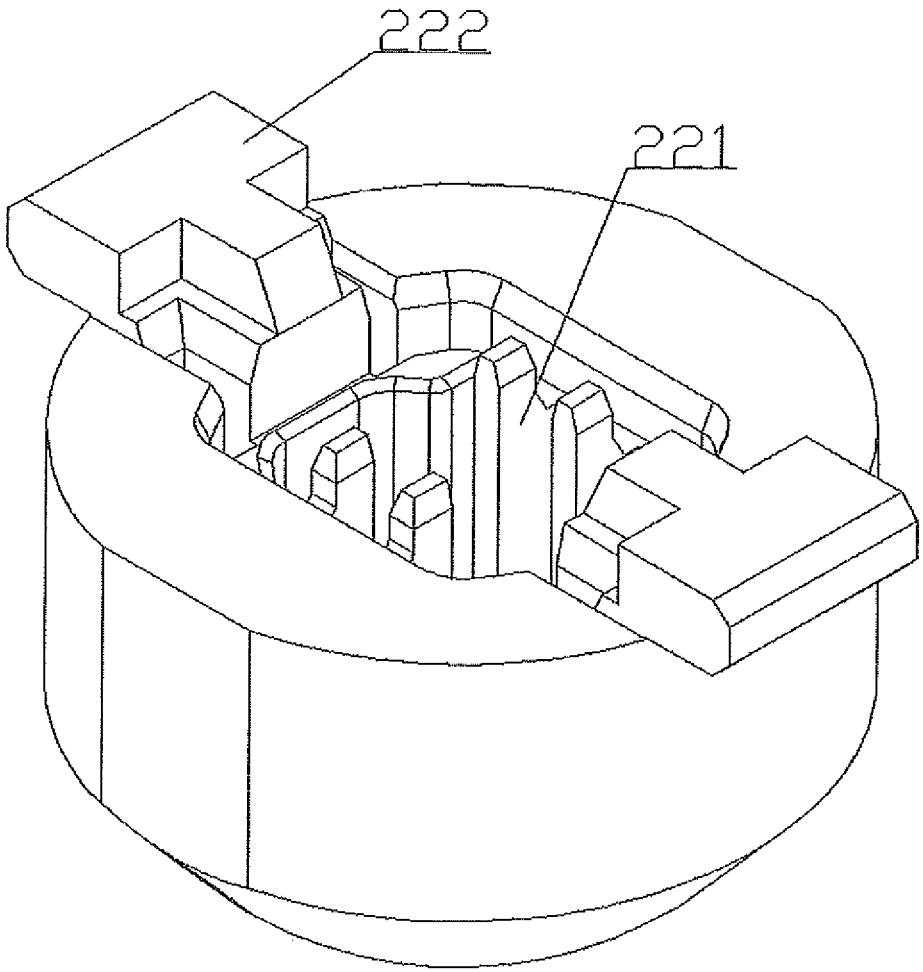
FIG. 6 is a perspective view of a female socket cover in a floating female socket with a self-return function from another angle according to the present disclosure.
Figure 7:
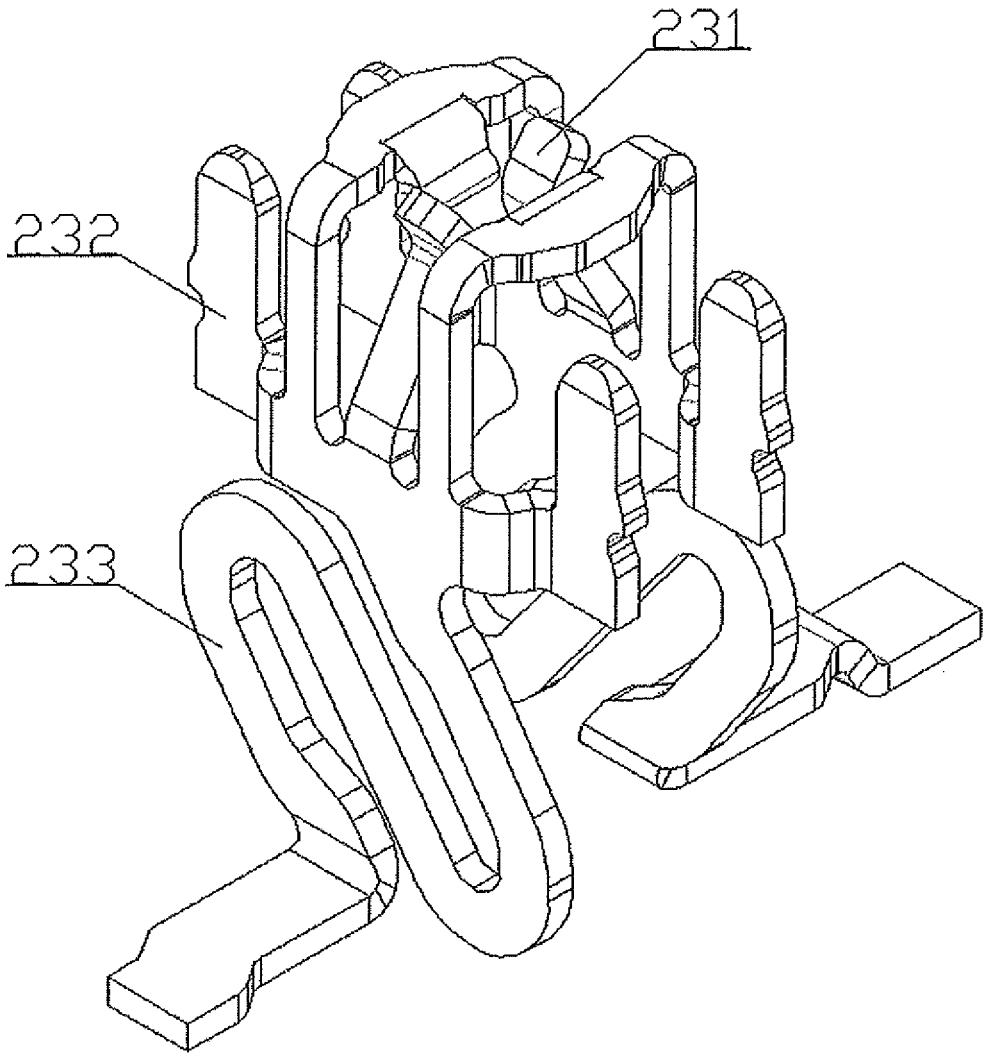
FIG. 7 is a perspective view of a female socket terminal in a floating female socket with a self-return function from one angle according to the present disclosure.

To ensure good power or signal transmission performance for the coaxial connector, a technical solution disclosed by the present disclosure applies a floating female socket. A detailed structure of the floating female socket and an action principle thereof are as follows: FIG. 2 and FIG. 3 are both perspective views of the floating female socket in the present disclosure. The floating female socket includes a female socket insulator 21, a female socket cover 22, a female socket terminal 23, and a shielding housing 24. The female socket insulator 21 is of a cavity structure (as shown in FIG. 4). The shielding housing 24 is of a metal plate structure, and encloses the female socket insulator 21. The female socket cover 22 is sleeved on and fastened to the female socket terminal 23, and can float relative to the female socket insulator 21. The female socket cover is sleeved on and fastened to the female socket terminal. The female socket terminal 23 is constituted by several parts such as a conduction part 231, insertion parts 232, and an elastic support part 233. The insertion parts 232 are disposed on left and right sides of the conduction part 231. The elastic support part 233 is fastened beneath the conduction part 231 (as shown in FIG. 7), so that the conduction part 231 stays in a floating state when external force is applied to the conduction part 231. The female socket cover 22 covers and clasps the conduction part 231 from directly above, and insertion slots 221 matched with the insertion parts 232 are disposed in a cavity of the female socket cover (as shown in FIG. 5 and FIG. 6). It should be emphasized that, the female socket cover 22 is totally separated from the female socket insulator 21, and is supported only by the female socket terminal 23.

The action principle of the floating female socket is as follows: When the male socket 1 of the coaxial connector and the female socket 2 of the coaxial connector are interconnected, the core shaft fastened to the male socket 1 applies force to the female socket terminal 23. At the same time, the elastic support part 233 adaptively deforms or inclines, so that the female socket cover 22 can fine-tune its position along an X-axis direction, a Y-axis direction, and/or a Z-axis direction. Further, the core shaft resides in a correct insertion position relative to the conduction part 231 of the female socket terminal 23. As such, impact on signal transmission stability can be effectively reduced by avoiding damage to fitting pieces of the coaxial connector caused by rigid assembly. Moreover, degradation of connection reliability of the coaxial connector caused by vibration and impact force can be alleviated to some extent.

To implement self-return actions of the female socket cover 22 and the female socket terminal 23, the preceding floating female socket 2 further needs to include two elastic guide plates 241 that are formed by upwardly extending left and right side walls of the shielding housing 24. The elastic guide plates 241 each include an elastic side top 2411 and an arc-shaped guide part 2412, where the elastic side top 2411 is configured to jack up against the female socket cover 22 and is formed by inwardly extending an inner wall of the elastic guide plate 241. The arc-shaped guide part 2412 is formed by externally bending and extending a free end of the elastic guide plate 241. When the male socket 1 of the coaxial connector is inserted and removed relative to the female socket 2 of the coaxial connector, the elastic guide plate 241 directly jacks up against a side wall of the female socket cover 22, so that the female socket cover 22 fine-tunes and corrects its position relative to the female socket insulator 21 along the X-axis direction and/or the Y-axis direction under an action of lateral thrust. In this way, the female socket cover 22 and the female socket terminal 23 reside in correct relative positions and get ready for a next plug-in mounting of the male socket 1 of the coaxial connector.

As a further improvement to the preceding floating female socket 2, the elastic side top 2411 is preferentially S-shaped, and externally extends away from a side wall of the female socket cover 22, so that the elastic side top 2411 has good elastic performance, and a self-return action of the female socket cover 22 is more timely and accurate in actual operations.

Moreover, inwardly bent elastic upper tops 242 extend upwardly from front and rear side walls of the shielding housing 24 to elastically abut an external enclosure of the male socket 1. Thus, in one aspect, the male socket 1 always stays in an elastically pressed and leaning state relative the female socket 2, to avoid rigid collisions between the male socket 1 and the female socket 2. In the other aspect, the core shaft has good contact stability relative to the female socket terminal 23. As a further preferred option, four such elastic upper tops 242 are disposed and are evenly and circumferentially distributed along a central axis of the shielding housing 24.

Figure 8:
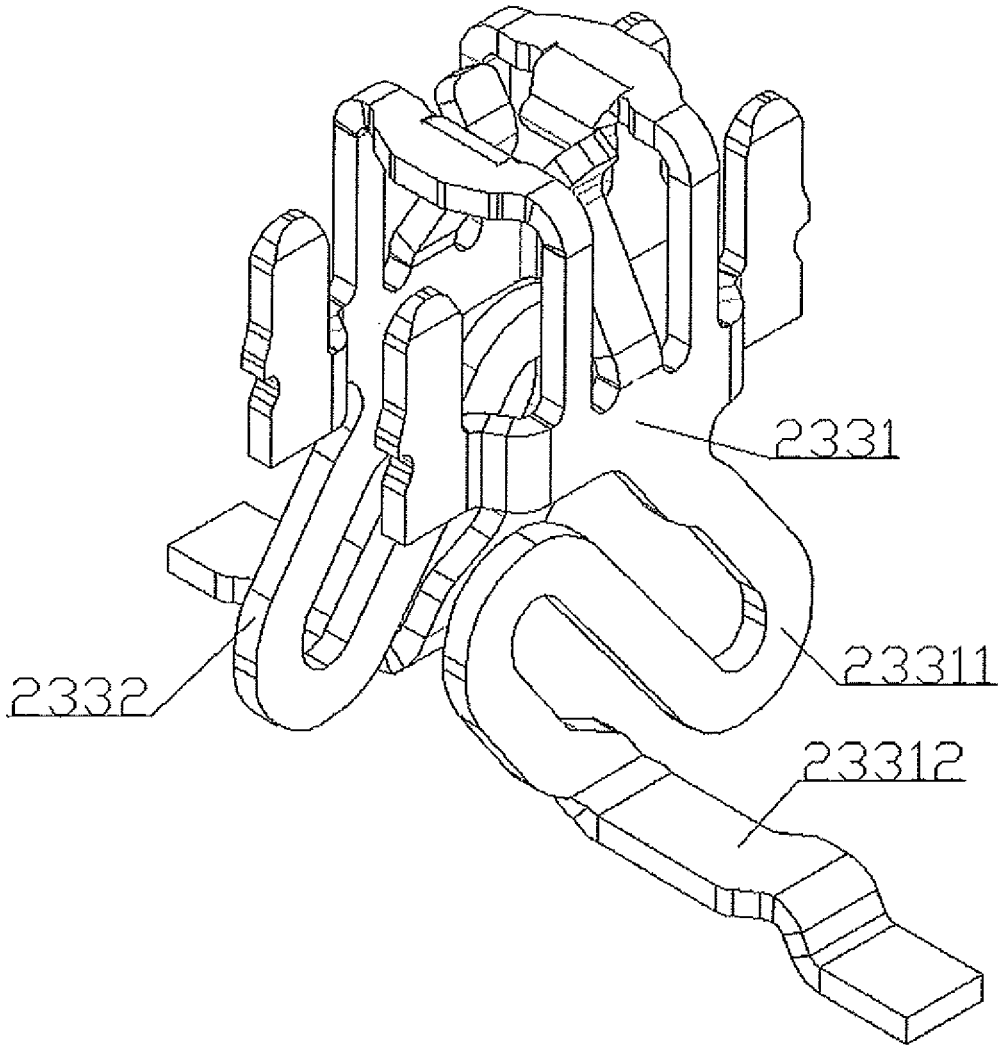
FIG. 8 is a perspective view of a female socket terminal in a floating female socket with a self-return function from another angle according to the present disclosure.

As a further improvement to the preceding floating female socket, the elastic support part 233 is preferentially constituted by a front connection body 2331 and a rear connection body 2332, so that the elastic support part 233 has better structural strength and action sensitivity. Specifically, the front connection body 2331 includes a front multi-bend elastic segment 23311 that is formed by downwardly extending a front side wall of the conduction part 231, and a front fastening segment 23312 that horizontally extends forward along a lower end of the front multi-bend elastic segment 23311 and that is inserted into a front side wall of the female socket insulator 21. The rear connection body 2332 is disposed in a similar way to that of the front connection body 2331, and includes a rear multi-bend elastic segment and a rear fastening segment (as shown in FIG. 8).

As a further improvement, the front multi-bend elastic segment 23311 and the rear multi-bend elastic segment are both S-shaped. It is known that, an S-shaped component has a relatively large amount of elastic deformation when it is squeezed or stretched under external force. Thus, applying small force to the core shaft can change a position of the elastic support part 233, thereby improving flexibility when the female socket terminal 23 supports a floating action.

It should be emphasized here that, the front multi-bend elastic segment 2331 is forward S-shaped and correspondingly the rear multi-bend elastic segment is preferentially reversely S-shaped. As such, when the female socket terminal 23 performs the floating action, the front multi-bend elastic segment 2331 and the rear multi-bend elastic segment withstand counterforce at the same time. In other words, the front multi-bend elastic segment 2331 withstands stretching force while the rear multi-bend elastic segment withstands compressive force; or the front multi-bend elastic segment 2331 withstands compressive force while the rear multi-bend elastic segment withstands stretching force. In this way, the female socket terminal 23 is more stable during self-adaptive position adjustment. In addition, more importantly, when the core shaft is removed from the female socket terminal 23, the female socket terminal 23 can perform a self-return action under a combined action of the front multi-bend elastic segment 2331 and the rear multi-bend elastic segment, and can get ready for a next plug-in mounting of the male socket.

Further, preferentially two stop blocks 222 may be disposed at the female socket cover 22, and are formed by externally extending a bottom wall of the female socket cover 22 along left and right directions (as shown in FIG. 6). Such practice reduces damage to the female socket terminal 23 caused by excessive downward insertion force from the male socket 1 (to be specific, when the elastic support part 233 of the female socket terminal 23 withstands excessive downward insertion force, the elastic support part 233 deforms excessively, and consequently the elastic support part 233 loses elasticity).

Figure 9:
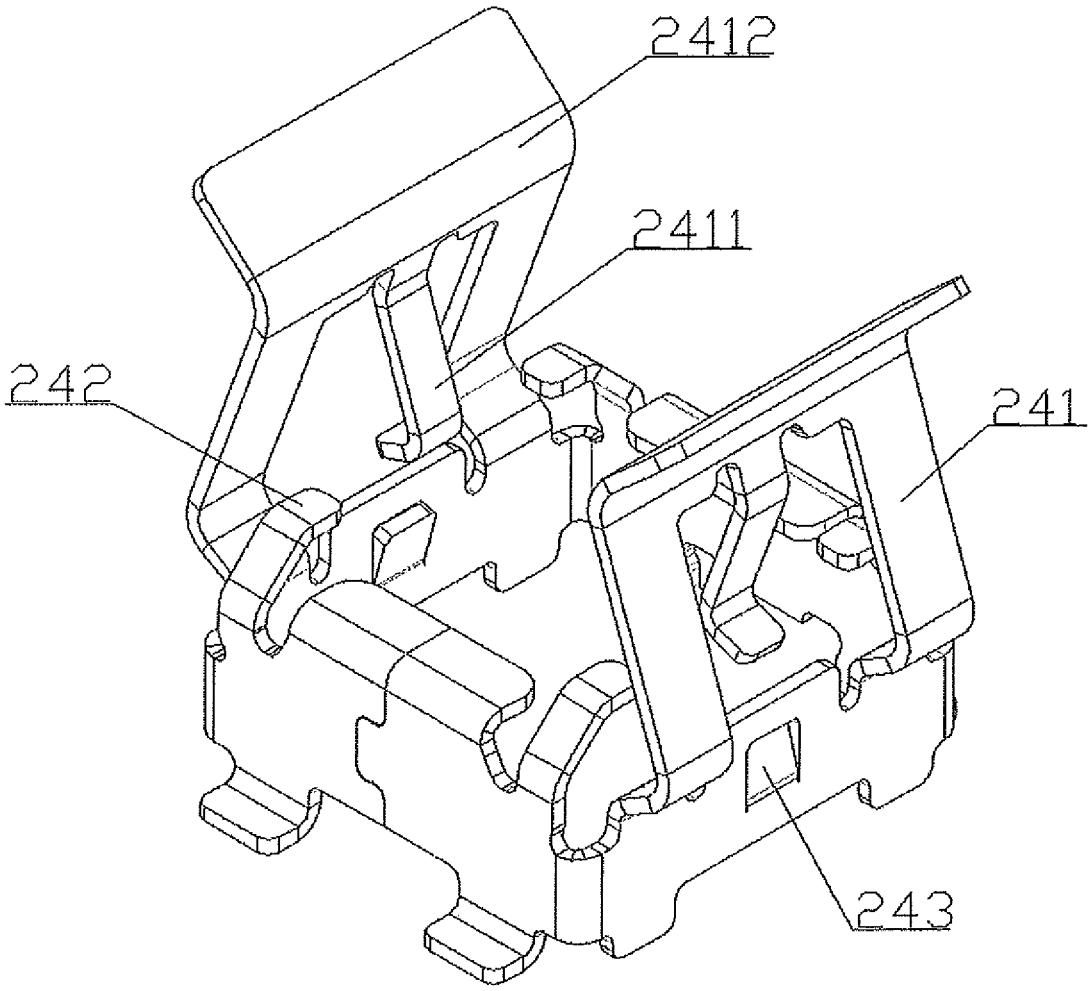
FIG. 9 is a perspective view of an implementation of a shielding housing in a floating female socket with a self-return function according to the present disclosure.

Furthermore, protruding parts 243 (shown in FIG. 9) can further be disposed on both the left and right side walls of the shielding housing 24 and correspondingly, grooves 211 (shown in FIG. 4) matched with the protruding parts 243 can be disposed on left and right side walls of the female socket insulator 21, so as to improve strength of connection between the shielding housing 24 and the female socket insulator 21 and facilitate disassembly.

Figure 10:
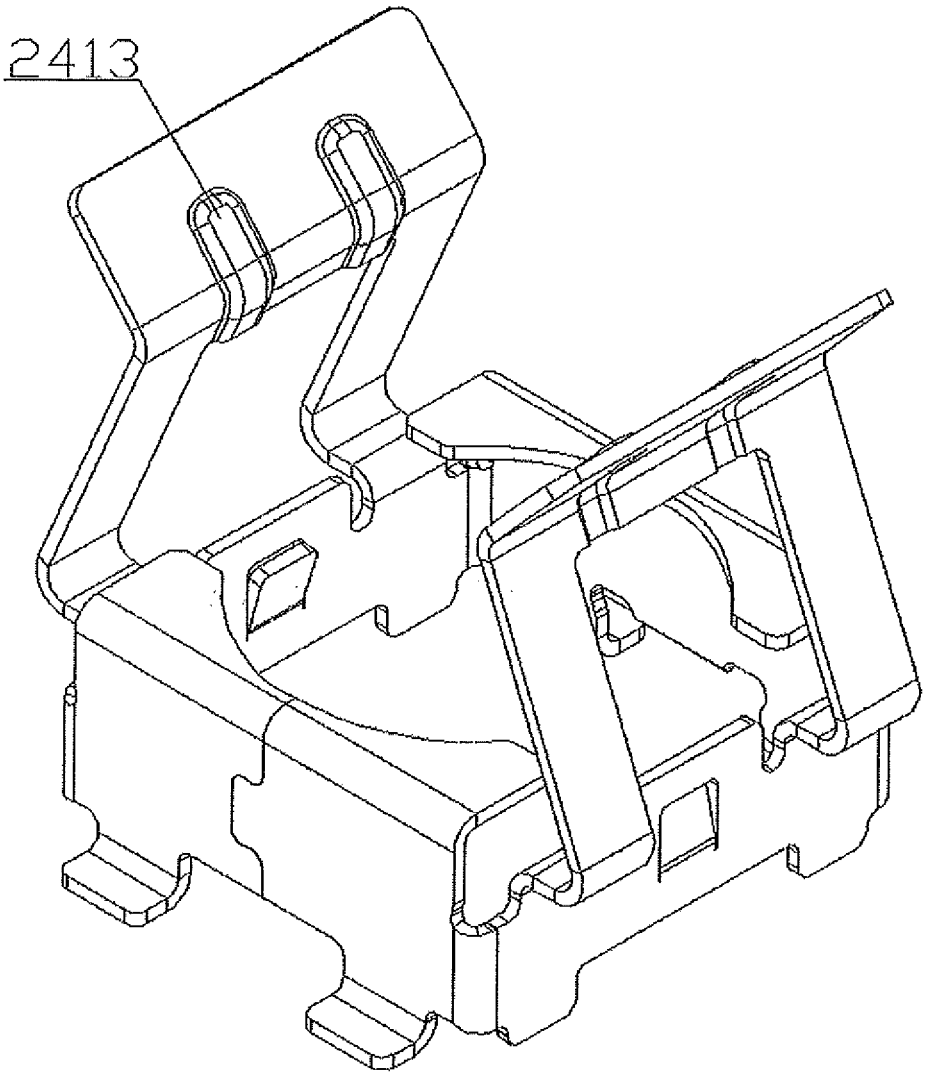
FIG. 10 is a perspective view of another implementation of a shielding housing in a floating female socket with a self-return function according to the present disclosure.

Finally, when the male socket 1 is actually inserted into the female socket 2, stability of the female socket terminal 23 decreases sharply if an angle of inclination of the core shaft exceeds a specific range, which affects a floating effect. For this, press-formed stop protrusions 2413 can be disposed on both elastic guide plates 241. There are at least two press-formed stop protrusions 2413 on each elastic guide plate 241, and the press-formed stop protrusions 2413 are evenly distributed along forward and backward directions of the arc-shaped guide part 2412 (as shown in FIG. 10). In this way, the press-formed stop protrusions 2413 can effectively control an insertion angle of the male socket 1 relative to the female socket 2, thereby improving stability of the female socket terminal 23 during floating.

The embodiments disclosed above are described to enable a person skilled in the art to implement or use the present disclosure. Various modifications to the embodiments are obvious to the person skilled in the art, and general principles defined in this specification may be implemented in other embodiments without departing from the spirit or scope of the present disclosure. Therefore, the present disclosure will not be limited to the embodiments described in this specification but extends to the widest scope that complies with the principles and novelty disclosed in this specification.

What is claimed is:

1. A floating female socket with a self-return function, comprising:

a female socket insulator;

a female socket cover floating relative to the female socket insulator;

a female socket terminal; and a shielding housing enclosing the female socket insulator;

wherein the female socket cover is sleeved on and fastened to the female socket terminal;

wherein the floating female socket further comprises two elastic guide plates that are formed by upwardly extending left and right side walls of the shielding housing, wherein the elastic guide plates each comprises an elastic side top and an arc-shaped guide part, wherein the elastic side top is configured to jack up against the female socket cover and is formed by inwardly extending an inner wall of the elastic guide plate; the arc-shaped guide part is formed by externally bending and extending a free end of the elastic guide plate; and when a male socket of a coaxial connector is inserted and removed relative to the female socket of the coaxial connector, the female socket cover is capable of fine-tuning and correcting a position relative to the female socket insulator along an X-axis direction and/or a Y-axis direction under an action of the elastic side top, so that the female socket cover and the female socket terminal reside in correct relative positions and get ready for a next plug-in mounting, of the male socket of the coaxial connector.

2. The floating female socket with a self-return function of claim 1, wherein the elastic side top is S-shaped, and externally extends away from a side wall of the female socket cover.

3. The floating female socket with a self-return function of claim 1, wherein inwardly bent elastic upper tops extend upwardly from front and rear side walls of the shielding housing to elastically abut an external enclosure of the male socket.

4. The floating female socket with a self-return function of claim 3, wherein four such elastic upper tops are disposed and are evenly and circumferentially distributed along a central axis of the shielding housing.

5. The floating female socket with a self-return function of claim 1, wherein the female socket terminal comprises a conduction part, insertion parts disposed on left and right sides of the conduction part, and an elastic support part fastened beneath the conduction part; the elastic support part is fastened in a cavity of the female socket insulator; the female socket cover covers and clasps the conduction part from directly above, and insertion slots matched with the insertion parts are disposed in a cavity of the female socket cover; the female socket cover is totally separated from the female socket insulator, and is supported only by the female socket terminal; and when the male socket of the coaxial connector is inserted relative to the female socket of the coaxial connector, the female socket cover is, capable of position fine-tuning relative to the female socket insulator along the X-axis direction, the Y-axis direction, and/or a Z-axis direction with help of the elastic support part, so that a male socket terminal resides in a correct insertion position relative to the conduction part.

6. The floating female socket with a self-return function of claim 5, wherein the elastic support part is constituted by a front connection body and a rear connection body, wherein the front connection body comprises a front multi-bend elastic segment that is formed by downwardly extending a front side wall of the conduction part, and a front fastening segment that horizontally extends forward along a lower end of the front multi-bend elastic segment and that is inserted into a front side wall of the female socket insulator; and the rear connection body comprises a rear multi-bend elastic segment that is formed by downwardly extending a rear side wall of the conduction part, and a rear fastening segment that horizontally extends backward along a lower end of the rear multi-bend elastic segment and that is inserted into a rear side wall of the female socket insulator.

7. The floating female socket with a self-return function of claim 6, wherein the front multi-bend elastic segment and the rear multi-bend elastic segment are both S-shaped and extend in opposite directions.

8. The floating female socket with a self-return function of claim 5, wherein two stop blocks are disposed at the female socket cover, and are formed by externally extending a bottom wall of the female socket cover along left and right directions.

9. The floating female socket with a self-return function of claim 5, wherein protruding parts are disposed on both the left and right side walls of the shielding housing and grooves matched with the protruding parts are disposed on left and right side walls of the female socket insulator.

10. A coaxial connector, comprising a male socket and a female socket that are interconnected, wherein the female socket is the floating female socket with a self-return function of claim 1.

11. The floating female socket with a self-return function of claim 2, wherein the female socket terminal comprises a conduction part, insertion parts disposed left and right sides of the conduction part, and an elastic support part fastened beneath the conduction part; the elastic support part is fastened in a cavity of the female socket insulator; the female socket cover covers and clasps the conduction part from directly above, and insertion slots matched with the insertion parts are disposed in a cavity of the female socket cover; the female socket cover is totally separated from the female socket insulator, and is supported only by the female socket terminal; and when the male socket of the coaxial connector is inserted relative to the female socket of the coaxial connector, the female socket cover is capable of position fine-tuning relative to the female socket insulator along the X-axis direction, the Y-axis direction, and/or a Z-axis direction with help of the elastic support part, so that a male socket terminal resides in a correct insertion position relative to the conduction part.

12. The floating female socket with a self-return function of claim 3, wherein the female socket terminal comprises a conduction part, insertion parts disposed on left and right sides of the conduction part, and an elastic support part fastened beneath the conduction part; the elastic support part is fastened in a cavity of the female socket insulator; the female socket cover covers and clasps the conduction part from directly above, and insertion slots matched with the insertion parts are disposed in a cavity of the female socket cover; the female socket cover is totally separated from the female socket insulator, and is supported only by the female socket terminal; and when the male socket of the coaxial connector is inserted relative to the female socket of the coaxial connector, the female socket cover is capable of position fine-tuning relative to the female socket insulator along the X-axis direction, the Y-axis direction, and/or a Z-axis direction with help of the elastic support part, so that a male socket terminal resides in a correct insertion position relative to the conduction part.

13. The floating female socket with a self-return function of claim 4, wherein the female socket terminal comprises a conduction part, insertion parts disposed on left and right sides of the conduction part, and an elastic support part fastened beneath the conduction part; the elastic support part is fastened in a cavity of the female socket insulator; the female socket cover covers and clasps the conduction part from directly above, and insertion slots matched with the insertion parts are disposed in a cavity of the female socket cover; the female socket cover is totally separated from the female socket insulator, and is supported only by the female socket terminal; and when the male socket of the coaxial connector is inserted relative to the female socket of the coaxial connector, the female socket cover is capable of position fine-tuning relative to the female socket insulator along the X-axis direction, the Y-axis direction, and/or a Z-axis direction with help of the elastic support part, so that a male socket terminal resides in a correct insertion position relative to the conduction part.

* * * * *